United States Patent [19]

Kress

[11] 4,073,601

[45] Feb. 14, 1978

[54] MARINE PROPELLER

[75] Inventor: Robert F. Kress, Grand Rapids, Mich.

[73] Assignee: Dana Corporation, Toledo, Ohio

[21] Appl. No.: 695,771

[22] Filed: June 14, 1976

Related U.S. Application Data

[63] Continuation-in-part of Ser. No. 530,696, Dec. 9, 1974, abandoned.

[51] Int. Cl.[2] ..... B63H 1/26

[52] U.S. Cl. ..... 416/242; 416/223 R

[58] Field of Search ..... 416/223 R, 242, 223 A

[56] References Cited

U.S. PATENT DOCUMENTS

| | | | |
|---|---|---|---|
| 2,157,999 | 5/1939 | Charavay | 416/242 |
| 2,682,925 | 7/1954 | Wosika | 416/223 X |
| 3,261,297 | 7/1966 | Daniel | 416/242 X |
| 3,514,215 | 5/1970 | Williams | 416/223 |
| 3,697,193 | 10/1973 | Phillips | 416/242 X |

FOREIGN PATENT DOCUMENTS

| | | | |
|---|---|---|---|
| 302,859 | 1/1918 | Germany | 416/242 |

*Primary Examiner*—Everette A. Powell, Jr.

*Attorney, Agent, or Firm*—Price, Heneveld, Huizenga & Cooper

[57] ABSTRACT

A marine propeller with unique blade geometry resistant to cavitation and ventilation at high speed operation. The face of the blade has a special convexly curved portion extending from the leading blade edge to a transition zone along the blade chord length toward the blade trailing edge, and a special concavely curved portion from this transition zone to the trailing blade edge, both defined herein.

2 Claims, 12 Drawing Figures

℄
.95

.9

.8

.7

.6

.5

.4

.3

MARINE PROPELLER

RELATED APPLICATION

This is a continuation-in-part application of my copending application Ser. No. 530,696, filed Dec. 9, 1974, now abandoned, and entitled MARINE PROPELLER.

BACKGROUND OF THE INVENTION

This invention relates to marine propellers, and more particularly to a marine propeller having a geometry resistant to cavitation and ventilation at high speed operation.

The function of marine propellers is based upon rather basic principles which have been generally accepted for many decades. Effective results from the rotating propeller depend upon maintaining optimum pressure differential between the front and back of the individual blades. Application of the basic propeller principles to actual operating conditions, however, involves the interplay of many complex variables resulting from the multidirectional fluid flow, vapor pressure factors, induction of air, and the interaction of these caused by the three dimensional, complexly configurated surfaces of the propeller. Consequently, the effective functioning of what would seem to be theoretically simple, is actually extremely complex, especially at high operational speeds, as is well known to those in this art. Therefore, propeller designers constantly experiment with propeller variations, and periodically discover hub or blade geometries that empirically function unexpectedly well, or unexpectedly poorly, for reasons that are not fully understood. As with the present invention, this sometimes occurs after long periods of trial and error experimentation with different configuration variations.

SUMMARY OF THE INVENTION

This invention centers around a marine propeller blade having unique configurational geometry effecting significantly superior performance at high operational speeds. Each blade face has a contour composed of a particular convex portion extending from the leading edge along a portion of the chord length, and a particular concave portion extending the remainder of the distance to the trailing edge. The convex portion and the concave portion have special dimensional relationships defined relative to the pitch datum line of the blade. For convenience, a pitch datum line is chosen which is generally outside the body of the blade and intersects the blade at its trailing edge.

The main object of the invention is to provide such a specifically configurated marine propeller blade resistant to cavitation and ventilation, effecting superior high speed performance.

DESCRIPTION OF THE PREFERRED EMBODIMENT

A marine propeller according to this invention includes a typical hub, which may be a conventional solid hub or a flow through hub, as for example, shown in U.S. Pat. No. 3,640,642, supporting a plurality of radially extending blades around the hub periphery.

Figure 1:
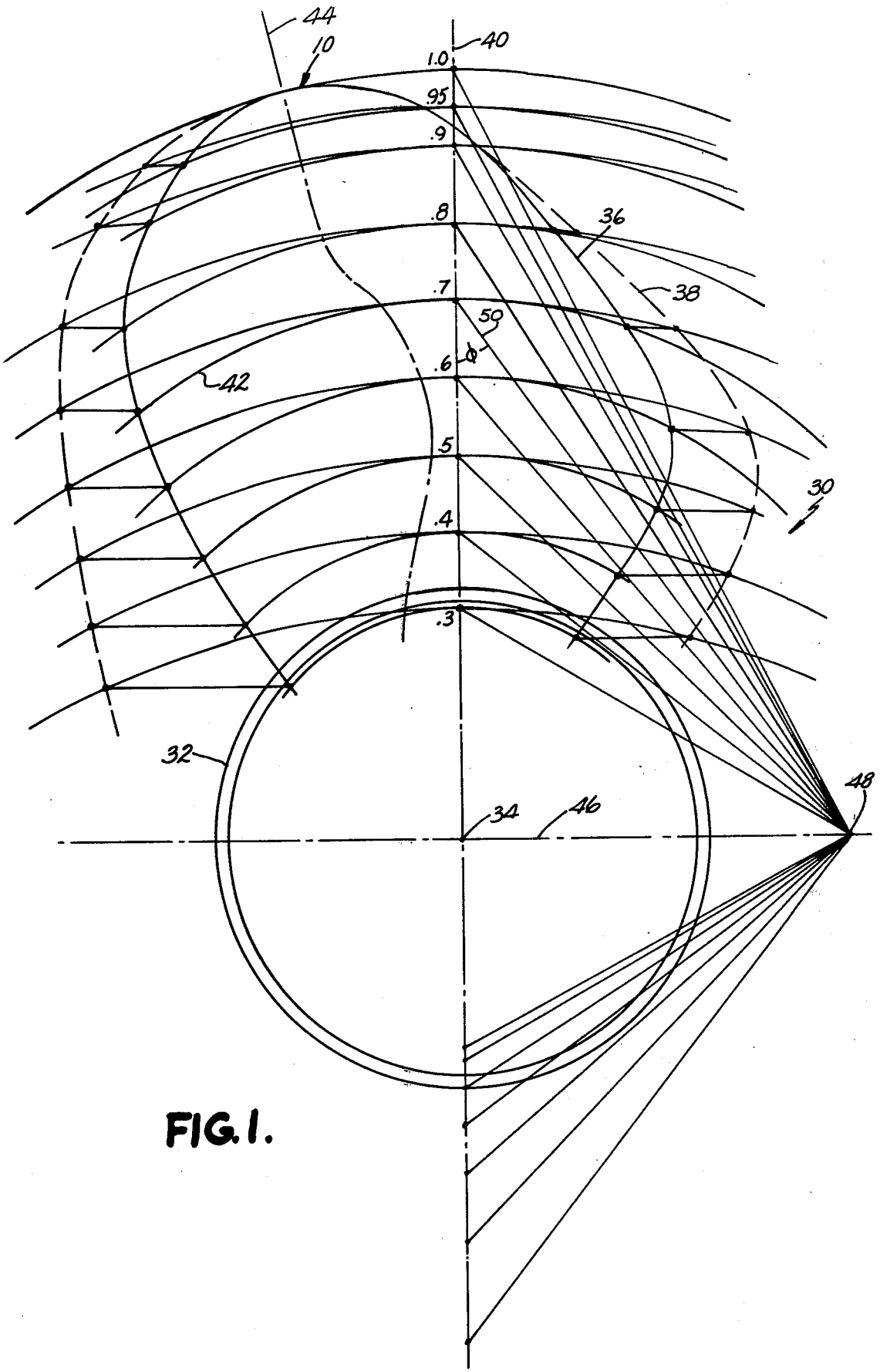
FIG. 1 is an end elevational view of a propeller, showing one blade with the novel blade configuration.
Figure 2:
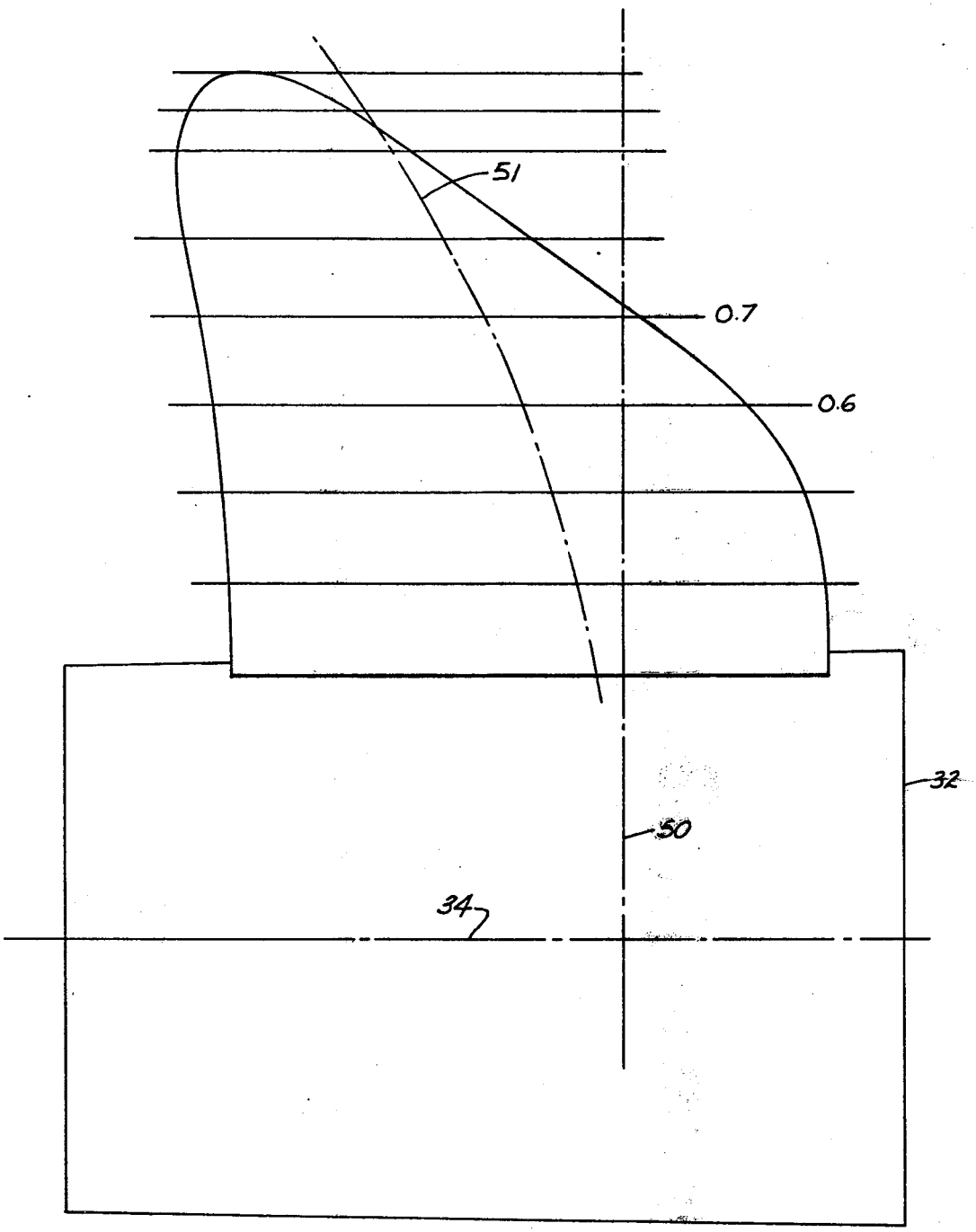
FIG. 2 is a side elevational view of the propeller in FIG. 1.
Figures 3A, 3B, 3C, 3D, 3E, 3F, 3G, 3H:
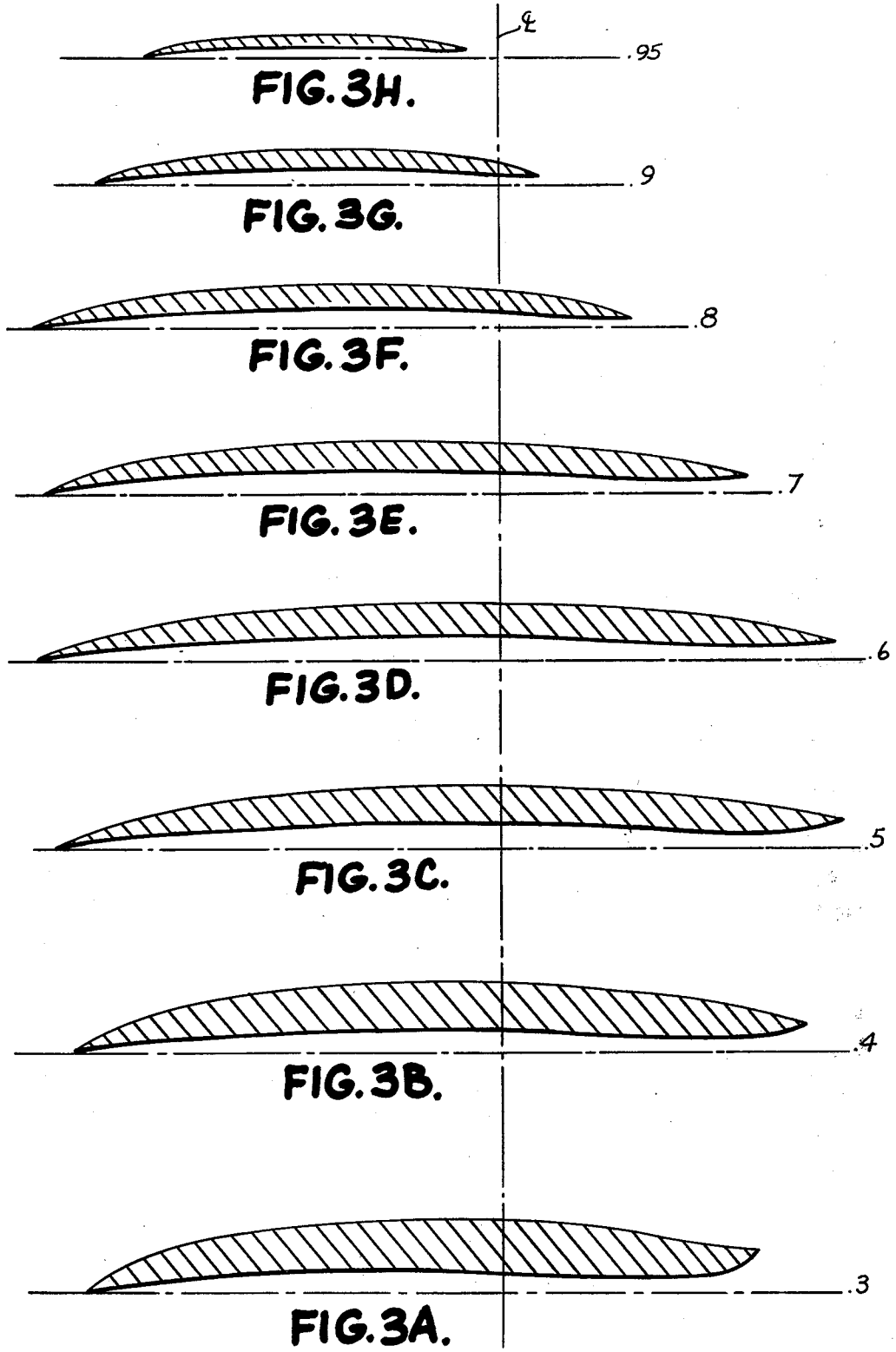
FIGS. 3A–3H are transverse, expanded, sectional views of the novel blade taken at progressive locations along the length of the blade.

In FIGS. 1–3, the configuration of the novel propeller is depicted, with construction lines drawn according to conventional techniques being included to clearly depict the nature of the blade. Only one of the plurality of blades is shown, to avoid excessive lines, it being realized by those in the art that a plurality of the blades are placed symetrically around the hub axis, each being a duplicate of that one shown.

In FIG. 1 is shown propeller 30 having hub 32 around rotational axis 34, with blade 10 being drawn in "projected" form in solid peripheral outline 36 and in "developed" form in dashed peripheral outline 38. The projected form is as the blade would look in outline from this angle, and the developed form is how it would look if flattened out to this angle. This terminology is common to the art. Vertical line 40 is a reference line through the axis 34. On this reference line is marked the one tenth of radius positions, i.e. 0.3, 0.4, 0.5, 0.6, 0.7, 0.8, 0.9, and 1.0, of blade radius R, with the half tenth 0.95 position also being noted according to conventional practice. Radius R is measured from the center, i.e. axis 34, to the outer end of the blade. The arcuate lines of constant radius from the center passing through these one tenth positions, e.g. arc 42 for the 0.7 position, designate the arcuate cross sectional surfaces shown as "expanded" sectional views in FIGS. 3A–3H. An expanded view is the curved surface illustrated in planar form. On a particular blade of radius R, the distance from center 34 to a particular tenth position is indicated as "$r$", e.g. at the 0.5 position of a propeller having a radius R of 10 inches, $r$ would be 0.5 (10) or 5. The line 44 (FIG. 1) indicates the blade center line, which is also the skew line.

On the horizontal reference line 46, normal to vertical reference line 40, is noted a reference point 48 (FIG. 1). This reference point is at a distance from hub center 34 an amount equal to the blade pitch divided by two $\pi$, i.e. $P/2\pi$, as shown. The particular propeller blade depicted as illustrative has a pitch of 21 inches. A straight line 50 scribed between reference point 48, and the intersection of a particular one tenth arcuate line (e.g. arc 42 for the 0.7 point) with the vertical work line 40 is at angle $\phi$ to vertical work line 40. Stated differently, the arc tangent of this angle $\phi$ is equal to the pitch divided by $2\pi r$, wherein $r$ is the distance from center 34 to the tenth mark of interest. Thus, at the 0.7 mark, on a blade for which R equals 10 inches for example, $r$ would be 0.7(R) or 0.7(10) or 7 inches. The angle $\phi$, i.e. the relationship of the pitch to any particular radial portion $r$, is used to locate the "pitch datum line" which is the reference line to define the unique configuration of the blade. This relationship is explained in detail hereinafter relative to FIGS. 4 and 5.

Figure 4:
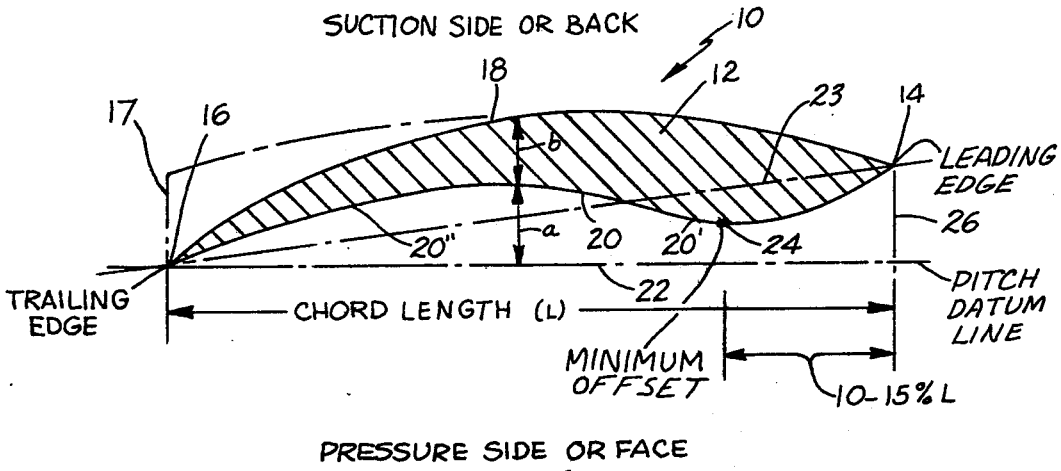
FIG. 4 is a schematic sectional view of the novel blade, with the curvatures being somewhat exaggerated for explanatory purposes.

In FIG. 4, the blade configuration is depicted with exaggerated curvature to clearly designate specified locations and dimensional relationships. As to the blade 10 in FIG. 4, blade body 12 includes a leading edge 14, a trailing edge 16, a suction side i.e. back 18, and a pressure side i.e. face 20. The blade face 20 is specially shaped, defined relative to a selected blade "pitch datum line" 22. Pitch datum line 22 constitutes a straight reference line at the angle $\phi$, the arc tangent of which is the blade pitch divided by $2\pi r$ as noted above. The angle of the pitch datum line is less than the "effective pitch" of the blade section. The "effective pitch" line is a straight line 23 extending through the trailing edge and the leading edge of the blade cross section. This chosen reference line 22, i.e. the pitch datum line, is outside the body of the blade, offset from the face thereof, intersecting the blade at the trailing edge 16. As indicated, the special curvature will be defined with this line as a reference. It will be understood that there is a reference pitch datum line for each radial portion $r$, at a different angle $\phi$ to the vertical, the series of angles being shown on FIG. 1.

Figure 5:
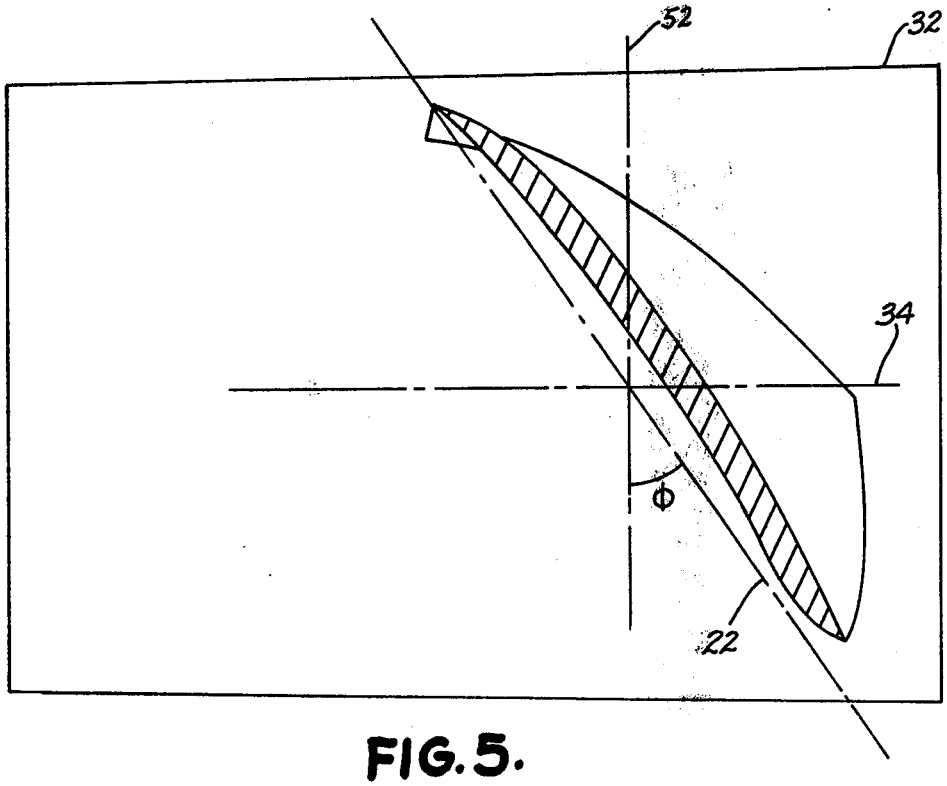
FIG. 5 is a plan view of the propeller in FIG. 2, with the blade being sectioned.

To further understand how this reference line is related to the blade cross section at a particular radial location, reference is had to FIG. 5. This figure is a sectional view taken at the 0.7 arc of FIG. 1 and FIG. 2, i.e. looking down on the propeller blade. Pitch datum line 22, at this section is at angle $\phi$ to the plane 52 normal to propeller axis 34. Line 22 extends through the trailing edge of the blade. Using line 22 as a reference, the blade configuration is as follows, reference being had to FIG. 4 wherein the curvatures have been exaggerated for illustrative purposes.

Face 20 consists of a convex surface portion 20' and a concave surface portion 20''. Convex surface portion 20' extends from leading edge 14 through a point 24 which is the "minimum offset point" of the blade face from the reference line 22, and then to a transition zone where the curvature becomes concave. This transition zone is about 20–25% along the chord length from the leading edge of the blade section. Point 24 is located at a distance from leading edge 14 about 10–15% of the "blade chord length". This minimum offset is about 1 to 2½% of the blade chord length. The blade chord length constitutes the straight line distance along the chosen pitch datum line from the trailing edge 16 to a line 26 (ordinate) normal to the pitch datum line and intersecting the leading edge 14. Concave surface portion 20'' extends from the transition zone to the trailing edge 16.

Convex surface 20' has a curvature as follows. The maximum distance or set back between the convex surface and the pitch datum line is at the leading edge and ranges between about 7% of the blade chord length (at the inner radii blade sections) to about 1% of the blade chord length (at the outer radii blade sections). This maximum distance is at leading edge 14, i.e. being the ordinate at leading edge 14. A blade section, like that in FIG. 4, is normally considered to fall on an "inner radius blade section" if the radial distance from that section to hub center 34 is less than the distance from the effective centroid of thrust of the blade to the hub center. The effective centroid of thrust is commonly accepted in the art to be at about the 0.7 position of R, i.e., about 70% of the distance from the center to the blade tip. If the radial distance from the blade section to the center of the hub is greater than the distance from the centroid of thrust to center, the section is considered to fall on an "outer radius".

Specifically referring to the illustrative blade in the drawings, the set back distance of leading edge 14 to the reference line, at the 0.3 position (FIG. 3A) is 6.8% of the blade chord length at that position; at the 0.4 position (FIG. 3B) is 4.3% of the blade chord length at that position; at the 0.5 position is 3.8% of the blade chord length; at the 0.6 position is 2.8% of that blade chord length; at the 0.7 position is 2.7% of that blade chord length; at the 0.8 position is 1.9% of that blade chord length; at the 0.9 position is 1.8% of the blade chord length and at the 0.95 position is 1.7% of that blade chord length.

At the particular radial tenth positions, the minimum offset point 24 has a distance from the pitch datum line within the range of about 1 to 2½% of the blade chord length at that radial position. In the specific blade depicted, it is 2.3% at the 0.3 position, 2.1% at the 0.4 position, 2.0% at the 0.5 position, 1.8% at the 0.6 position, 1.7% at the 0.7 position, 1.3% at the 0.8 position, 1.8% at the 0.9 position, and 2.0% at the 0.95 position.

Concave surface 20'' has a curvature or camber ranging from a maximum spacing from the reference line at about mid-chord length, to 0 at the trailing edge 16. In terms of the distance of the concave surface from the pitch datum line, this maximum at mid-chord length is about 2–3 ½% of the blade chord length. In the particular blade depicted, the maximum displacement from the pitch datum line at the 0.3 position is 3.3% of the blade chord length at that position, 3.2% at the 0.4 position, 3.0% at the 0.5 position, 2.8% at the 0.6 position, 2.7% at the 0.7 position, 2.6% at the 0.8 position, 2.9% at the 0.9 position, and 2.9% at the 0.95 position.

Extensive experimentation of marine propellers having blades within the parameters set forth above has shown significantly superior performance, especially at high operational speeds. This is believed to be basically because of ventilation and cavitation resisting characteristics of the novel geometry. Extremely high thrust or lift is produced at speeds in a range of about 30 knots and up. This has been established for speeds up to about 60 knots by actual tests, and it is believed that the superior performance continues above 60 knots.

The particular configuration of the back surface 18 is not found to be important. It is usually convexly curved for optimum strength to weight ratio. Further, the trailing edge can be altered from that shown without appreciable effect. For example, it can be relatively thick and blunt if desired, as shown by phantom lines at 17, rather than feathered as depicted in solid lines, without loss of the superior performance, provided the face surface configuration parameters set forth herein are maintained. Other minor variations could also conceivably be employed for particular propeller applications, provided the face surface parameters set forth are maintained for the blade. For example, the rake can be varied from that illustrated by the rake center line 51 (FIG. 2).

The embodiments of the invention in which an exclusive property or privilege is claimed are as follows.

1. A marine propeller having specially configurated blades exhibiting resistance to ventilation and cavitation at high speed operation, each blade including a leading edge, a trailing edge, a face constituting a pressure side, and a back constituting a suction side;

said face having a contour consisting of a convex surface extending from said leading edge to a transition zone about 20–25% of the blade chord length toward said trailing edge, and a concave surface extending the remainder of the chord length to said trailing edge;

said convex and concave surfaces having curvatures defined relative to reference pitch datum lines at particular radial blade sections, said reference line at any particular radial blade section being a straight line outside of said blade, intersecting said blade trailing edge, and at an angle $\phi$ to a plane transverse to the propeller axis, the arc tangent of said angle $\phi$ being the blade pitch divided by $2\pi r$, where $r$ is the distance of the particular radial blade section from the propeller axis; said blade having its maximum set back from said pitch datum line at said leading edge, said set back being between about 7% of the blade chord length at the inner radii blade sections to about 1% of the blade chord length at the outer blade chord sections;

said blade convex surface having minimum offset from said pitch datum line at about 10 to 15% of the blade chord length from said leading edge, said offset being about 1 to 2½% of the blade chord length;

said blade concave surface having a maximum spacing from said pitch datum line at about mid-chord length, said spacing being about 2 to 3½ of the blade chord length from said pitch datum line.

2. The marine propeller blade in claim 1 wherein said back is convexly curved from said leading edge toward said trailing edge.

* * * * *